US005098655A

United States Patent [19]

Ohba

[11] Patent Number: 5,098,655

[45] Date of Patent: Mar. 24, 1992

[54] ELECTRICAL CONTACT ALLOY

[75] Inventor: Masatoshi Ohba, Kyoto, Japan

[73] Assignee: Omron Tateisi Electronics Co., Kyoto, Japan

[21] Appl. No.: 357,195

[22] Filed: May 26, 1989

[30] Foreign Application Priority Data

May 28, 1988 [JP] Japan ..... 63-131193
May 28, 1988 [JP] Japan ..... 63-131194

[51] Int. Cl.[5] ..... C22C 30/00

[52] U.S. Cl. ..... 420/501; 420/505; 420/507; 420/576; 420/580

[58] Field of Search ..... 420/501, 505, 507, 511, 420/576, 580

[56] References Cited

U.S. PATENT DOCUMENTS 3,036,139 5/1962 Feduska et al. ..... 420/580
3,117,864 1/1964 Heath et al. ..... 420/507
4,547,436 10/1985 Rellick ..... 420/507

FOREIGN PATENT DOCUMENTS 0014212 1/1984 Japan ..... 420/501
0014218 1/1984 Japan ..... 420/501

*Primary Examiner*—Olik Chaudhuri
*Assistant Examiner*—Felisa Garrett-Meza
*Attorney, Agent, or Firm*—Foley & Lardner

[57] ABSTRACT

The electrical contact alloy is provided comprising Sb and either Au or Ag or both. In such alloys, Sb produces a non-catalytic effect to inhibit formation of carbon from organic gases derived from resin parts. Therefore, when electrical contacts of such alloys are assembled with resin parts into housings, poor contact due to carbon deposition is prevented to increase the useful life and reliability of the electrical contacts.

11 Claims, 3 Drawing Sheets

ELECTRICAL CONTACT ALLOY

BACKGROUND OF THE INVENTION

1. Field of the Invention

This invention relates to an electrical contact alloy for use in sealed electromagnetic relays, and more particularly, to an electrical contact alloy which aids in preventing the deposition of carbon residue on the surfaces of the contact.

2. Description of the Related Art

Generally, in sealed solenoid relays or other electrical devices which are fabricated by assembling various component parts into a housing, low-boiling hydrocarbon organic gases evolved from resin parts, such as ethane, methane, benzene and xylene, tend to be trapped and collect within the housing. These organic gases are oxidized and decomposed by the arc and mechanical energies associated with the switching actions of the electrical contact, and the resulting deposits of carbon on the surface of the contact points cause poor contact. This phenomenon is particularly pronounced at higher ambient temperatures. Therefore, degassing of the plastic parts prior to assembly is the common practice.

However, the organic gases included in the resin parts cannot be completely removed by such a degassing operation. Thus, the gradual deposition of carbon on the contact surfaces and the consequent poor contact have been unavoidable. Furthermore, for sealed electromagnetic relays, which are used for low-level signal switching, expensive materials such as gold (Au) metal and Au alloys have previously been used as contact materials for improved reliability. However, since such electrical contacts tend to develop poor contact in the presence of even trace amounts of carbon, the reliability of these relays has not been sufficient.

OBJECTS AND SUMMARY OF THE INVENTION

Accordingly, it is an object of this invention to provide an electrical contact alloy which reduces the formation of carbon from organic gases collecting in a sealed housing.

A further object of the preset invention is to provide an electrical contact alloy which enhances reliability of contact devices.

The present invention contemplates providing an electrical contact alloy comprising antimony (Sb) and either Au or silver (Ag) or both. In such alloys, Sb produces a non-catalytic effect to inhibit formation of carbon from organic gases derived from resin parts. Therefore, when electrical contacts of such alloys are assembled with resin parts into housings, poor contact due to carbon deposition is prevented thereby increasing the useful life and reliability of the electrical contacts.

BRIEF DESCRIPTION OF THE DRAWINGS

The above and other objects, advantages and features of this invention will be more fully understood and appreciated when considered in conjunction with the accompanying drawings.

DETAILED DESCRIPTION OF THE PREFERRED EMBODIMENTS

The present invention contemplates a method and alloy for preventing deposition of carbon residue on electrical contact surfaces. An electrical contact is provided comprising an alloy of antimony with one or both of gold and silver. It has been found to be particularly advantageous if the proportion of Sb in the Sb-Au binary alloy of this invention is not more than 55.26 percent by weight. Sb has a non-catalytic effect to inhibit the formation of carbon from organic gases in association with switchings of the contact. However, if the level of Sb exceeds 55.26 percent by weight, Sb tends to precipitate out thereby causing an increased contact resistance which interferes with the function of the contact for low-level signal use. It should be understood that although Sb exhibits a non-catalytic effect even in trace amounts, it is generally preferable to use this element at a level not less than 0.1 percent by weight.

The Sb—Au electrical contact alloy of this invention can be produced by the known technology.

EXAMPLES 1 AND 2

Au and Sb were melted together in a furnace according to the above formula and, then, cooled to solidify.

By the above method, the following contact samples (Examples 1 and 2) and a control sample (Comparative Example 1) were prepared

| | Composition (% by weight) | |
|---|---|---|
| | Au | Sb |
| Example 1 | 60 | 40 |
| Example 2 | 96.3 | 3.7 |
| Control | 100 | — |

Figure 1:
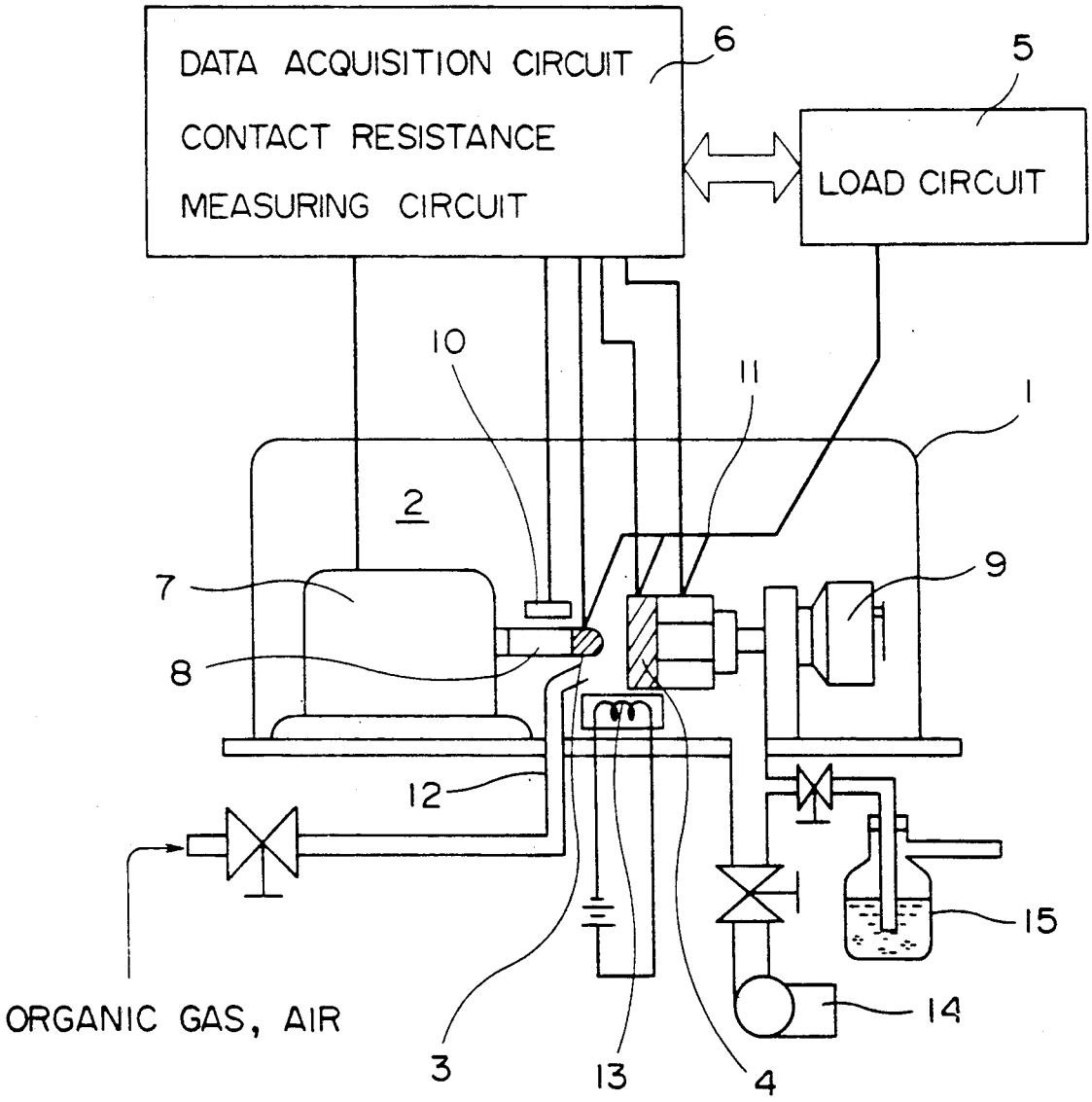
FIG. 1 is a schematic view, in section, showing a test apparatus used in the testing of the electrical contact alloy of this invention.

Using the testing apparatus illustrated in FIG. 1, these samples were tested for change in contact resistance as a function of the number of switchings.

Referring to FIG. 1, a tester housing 1 is made of a transparent glass. In a closed internal space 2 shielded from the atmosphere, contact members and 4 of the test alloy having the composition shown above are disposed in such a manner that they can be brought into contact and separated from each other. A load circuit 5 supplies a current to the contact members 3 and 4. In this arrangement, the contact resistance was measured by means of a contact resistance measuring circuit and a data acquisition circuit, which are generally indicated by the reference numeral 6.

The contact member 3 is mounted at the end of a horizontally movable spindle 8 of an impacter 7, while the contact member 4 is mounted at the end face of a stationary jig 9, the horizontal position of which can be finely adjusted. A displacement sensor 10 is disposed near spindle 8, while a pressure sensor 11 is disposed in the stationary jig 9, optimizing the switching action.

The space 2 can be supplied with a mixture of an organic gas and air through a nozzle 12. The space 2 can be maintained at a predetermined temperature and pressure by means of a heater disposed within the space 2, a vacuum pump 14 and an oil trap 15 connected to said space 2.

In the experiment, a gaseous mixture of air and benzene (benzene concentration: 5% by volume) was introduced into the space 2 and while the internal temperature of the space 2 was kept at 50° C. The contact members 3 and 4 were opened and closed at a frequency of 10 Hz. The changes in contact resistance of each sample were measured with a load current of 13.3 V and 25 mA. The results are shown in FIG. 2.

Figure 2:
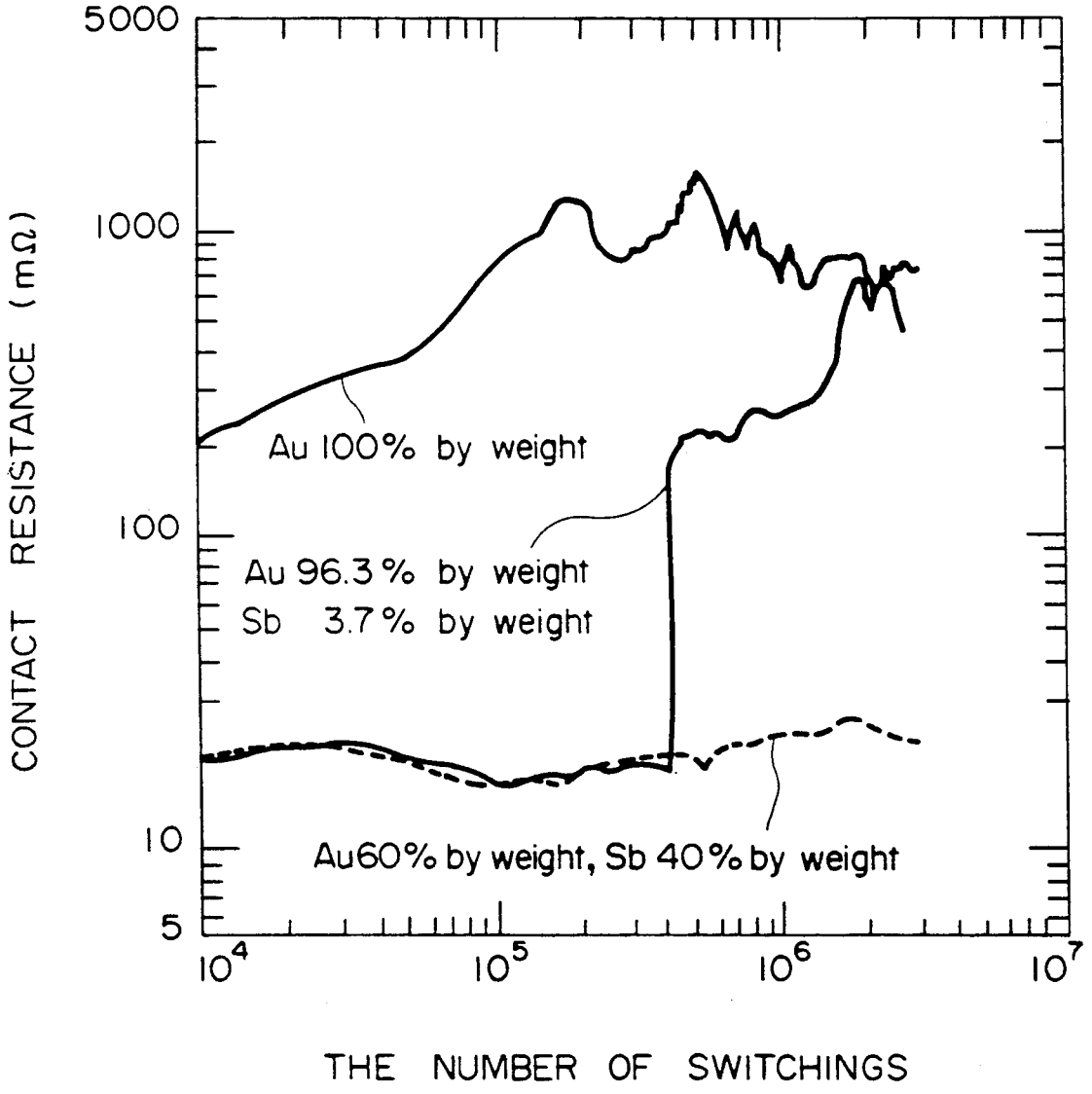
FIGS. 2 and 3 are graphs showing the results of measurement of contact resistance.

It will be apparent from FIG. 2 that the control sample (Comparative Example 1) showed a higher contact resistance than the Sb—Au samples of the present invention (Examples 1 and 2) even before the switching of the contacts and showed gradually increasing contact resistance values as the number of switchings increased. When the number of switchings exceeded $1\times10^5$, the contact resistance of the control sample became extremely unstable.

In contrast, samples of the present invention (Examples 1 and 2) showed lower contact resistance values even before the switching began. Particularly the sample of this invention containing 40% by weight of Sb (Example 1) showed substantially no change in contact resistance even after $1\times10^6$ switchings, indicating that the contact of this alloy has an extraordinarily extended serviceable life.

Moreover, even sample 2 (Example 2) containing 3.7% by weight of Sb showed an increased contact resistance only after $4\times10^5$ switchings, indicating that this alloy, too, provides a contact having a longer life than the control.

After the experiment, the surface of each contact was examined. This examination showed that whereas the control sample showed deposits of carbon on the surface, no deposition of carbon was found in the case of samples I and II (Examples 1 and 2).

This difference was apparently attributable to the inhibitory effect of Sb on the formation of carbon from organic gases.

EXAMPLE 3

Another example of this invention is described below. This example is a Sb—Au—Ag ternary alloy.

In the ratio of Sb to Au plus Ag, if the proportion of Sb exceeds 49.7 percent by weight, Sb tends to precipitate out to increase the contact resistance to make the alloy unsuited for low-level signal use. Therefore, the upper limit of Sb was set at 49.7 percent by weight. As in the binary alloy, while Sb has a non-catalytic effect even at a very low addition level, generally it is preferably used in proportion not less than 0.1 percent by weight.

In the ratio of Au to Ag, if Au is less the 88.0 percent by weight, the contact becomes vulnerable to corrosion. On the other hand, if Au exceeds 93.0 percent by weight, fusion of contacts is likely. Therefore, the proportion of Au to Au plus Ag was set within the range of 88.0 to 93.0 percent by weight.

The method for manufacture of this alloy may be the same as mentioned in Examples 1 and 2.

By this method, the following contact samples were manufactured.

| | Composition (percent by weight) | | |
|---|---|---|---|
| | Au | Ag | Sb |
| Example 3 | 81 | 9 | 10 |
| Control (Comparative Example 2) | 90 | 10 | — |

These samples were tested under the same conditions as in Examples 1 and 2. The results are shown in FIG. 3.

Figure 3:
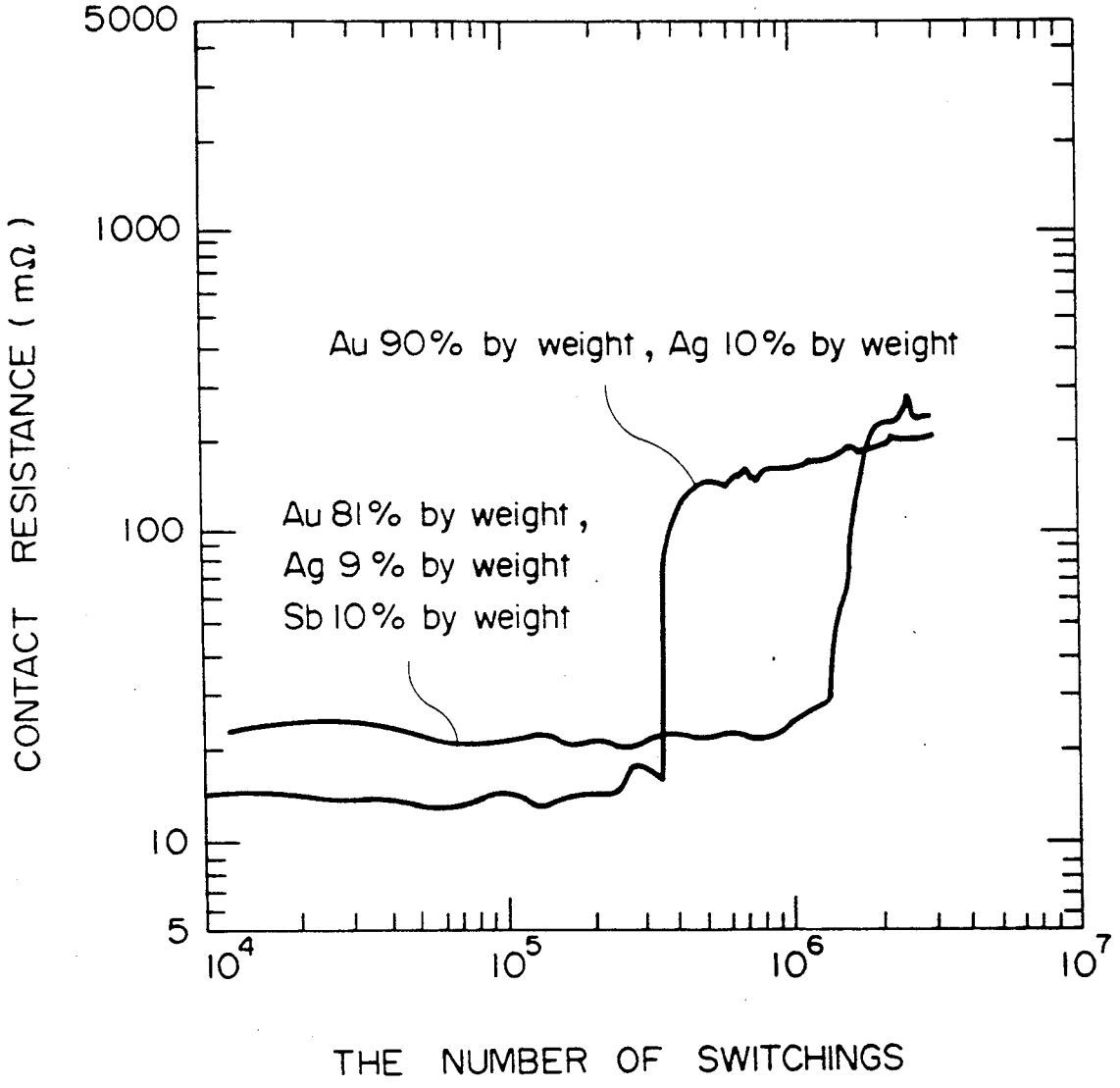

It will be apparent from FIG. 3 that whereas the control sample (Comparative Example 2) showed a sharp increase in contact resistance as the number of switchings exceeded $3\times10^5$, the sample of this invention showed an increase in contact resistance only after $1\times10^6$ switchings.

The examination of the contact surfaces after the experiment revealed deposits of carbon on the control sample but the sample of this invention (Example 3) showed no deposition of carbon.

This effect was apparently attributable to an inhibitory effect of Sb on the formation of carbon from the organic gas contained in the space.

While relative to the control sample the ternary alloy sample of the present invention showed somewhat increased contact resistance values up to the time when the control sample showed a sharp increase in contact resistance, these increased values were not practically significant.

The above description and the accompanying drawings are merely illustrative of the application of the principles of the present invention and are not limiting. Numerous other arrangements which embody the principles of the invention and which fall within its spirit and scope may be readily devised by those skilled in the art. Accordingly, the invention is not limited by the foregoing description, but is only limited by the scope of the appended claims.

What is claimed is:

1. An electrical contact alloy comprising Sb and Au and Ag and wherein the resulting ternary alloy has the general formula:

$$(Au_yAg_{100-y})_{100-x}Sb_x$$

wherein x is less than or equal to about 49.7 percent by weight and y is being 88.0 to 93.0 percent by weight, inclusive of the weight of (100−x).

2. The electrical contact alloy according to claim 1 wherein Sb is present in a proportion less than or equal to 55.26 percent by weight relative to Au.

3. The electrical contact alloy according to claim 2 wherein the proportion of Sb relative to Au is greater than or equal to 0.1 percent by weight.

4. The electrical contact alloy according to claim 2 wherein the proportion of Sb relative to Au is equal to about 40 percent by weight.

5. An electrical contact alloy according to claim 1, wherein Sb is present in a proportion less than or equal to 55.26 percent by weight relative to Au.

6. The electrical contact alloy according to claim 5, wherein the proportion of Sb relative to Au is greater than or equal to 0.1 percent by weight.

7. The electrical contact alloy according to claim 5, wherein the proportion of Sb relative to Au is equal to about 40 percent by weight.

8. An electrical contact alloy as recited in claim 5, wherein the proportion of Sb relative to Au is greater than or equal to 0.1 percent by weight and less than 3 percent by weight.

9. An electrical contact alloy as recited in claim 5, wherein the proportion of Sb relative to Au is less than or equal to 55.26 percent by weight relative to Au and greater than 25 percent by weight relative to Au.

10. An electrical contact alloy as recited in claim 5 wherein the proportion of Sb relative to Au is greater than or equal to 0.1 percent and less than 2.25 percent by weight.

11. An electrical contact relay as recited in claim 5 wherein the proportion of Sb relative to Au is less than or equal to 55.26 percent and greater than 22 percent by weight relative to Au.

* * * * *